US006557463B2

(12) United States Patent
Metzger et al.

(10) Patent No.: US 6,557,463 B2
(45) Date of Patent: May 6, 2003

(54) PROCESS FOR DRIVING A WORKPIECE TRANSPORT SYSTEM FOR A PRESS ARRANGEMENT

(75) Inventors: Kurt Metzger, Goeppingen (DE); Burkhard Schumann, Ottenbach (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 0 days.

(21) Appl. No.: 09/875,251

(22) Filed: Jun. 7, 2001

(65) Prior Publication Data

US 2002/0020306 A1 Feb. 21, 2002

(30) Foreign Application Priority Data

Jun. 7, 2000 (DE) ..... 100 28 147

(51) Int. Cl.[7] ..... B30B 1/16

(52) U.S. Cl. ..... 100/35; 72/453.03; 72/455; 100/272

(58) Field of Search ..... 72/451, 453.03, 72/454, 455; 83/524, 530, 639.1; 100/35, 272, 286

(56) References Cited

U.S. PATENT DOCUMENTS 5,562,026 A * 10/1996 Hennig ..... 100/35

FOREIGN PATENT DOCUMENTS

| | | |
|---|---|---|
| DE | 291869 | 10/1953 |
| EP | 0511028 B1 | 7/1996 |

* cited by examiner

*Primary Examiner*—W. Donald Bray
(74) *Attorney, Agent, or Firm*—Crowell & Moring LLP

(57) ABSTRACT

A process for operating a workpiece transport system for a press arrangement includes driving, the system by at least one driving device which can be held in a stoppage position with a braking device. By application of a predefined torque by the driving device, the functioning of the braking device is checked.

11 Claims, 1 Drawing Sheet

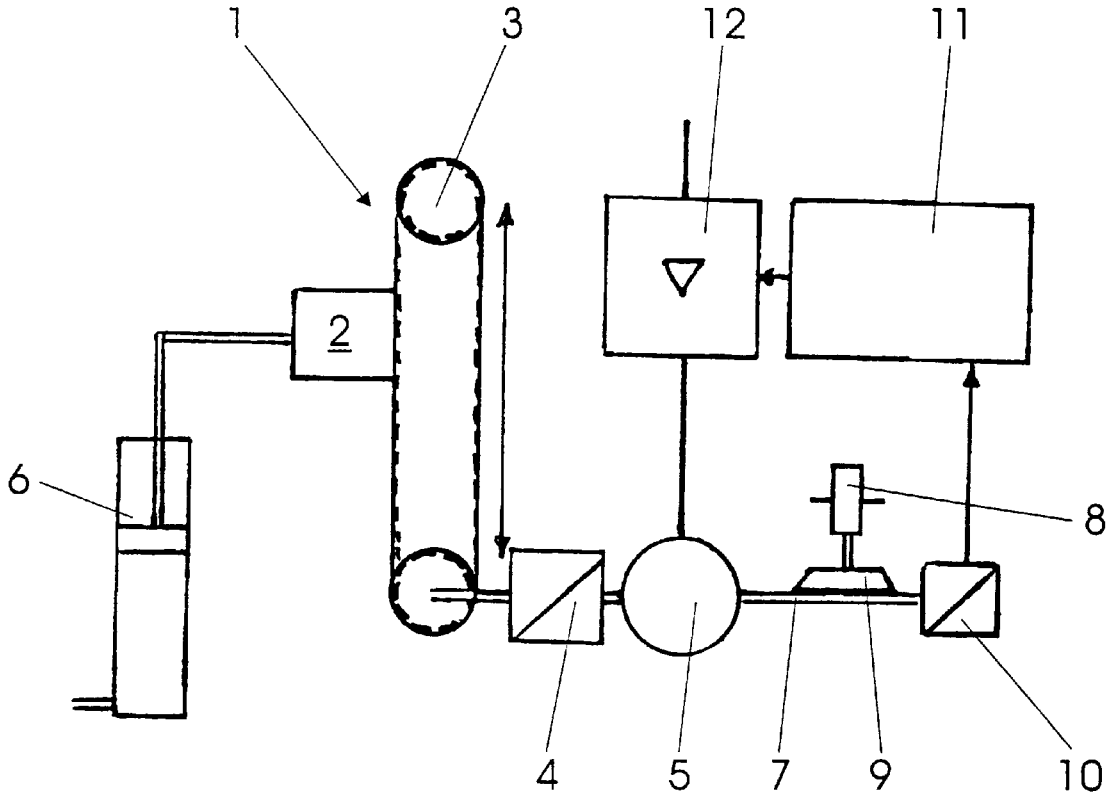
1
3
12
11
2
6
8
4
5
7
9
10

PROCESS FOR DRIVING A WORKPIECE TRANSPORT SYSTEM FOR A PRESS ARRANGEMENT

BACKGROUND OF THE INVENTION

This application claims the priority of German Patent Document 100 28 147.8, filed Jun. 7, 2000, the disclosure of which is expressly incorporated by reference herein.

The present invention relates to a process for operating a workpiece transport system for a press arrangement and to a system for implementing the process.

The braking devices used in known processes have the purpose of avoiding, at the point in time at which the press arrangement is not operating, the risks resulting from the potential energy of lifting parts of such systems or from the energy of the counterweight because of a possible movement of the parts downward or upward. Such devices, which are also called holding brakes, have friction linings which are designed such that they can carry out only a limited number of operational brakings; that is, brakings while in motion, because constructively they are not designed for this purpose. Such operational brakings may be necessary, for example, as a result of power failure or faulty connections during the start of the operation.

As the wear of the friction linings of the braking devices increases, however, the braking torque which can be applied decreases. Thereby a secure holding of the system parts is no longer ensured, and the potential energy of these parts represents a danger.

As an alternative, knows mechanical holding devices are used which have a form fit with respect to the respective system part. However, the manufacturing of these holding devices requires relatively high expenditures, and these holding devices must be adapted separately to each system. Therefore, relatively high costs are incurred.

In contrast, the normally used, above-described braking devices are standard parts, which result in relatively low costs and very low mounting expenditures. Another advantage of the known braking devices is the lower required braking torque because the braking device is usually followed by a gearing down of the drive and thus an increase of the torque.

With respect to the general prior art concerning braking devices in the case of workpiece transport systems for press arrangements as well as processes for operating workpiece transport systems for press arrangements, reference is made to CH-PS 291 869 and EP 0 511 028 B1.

SUMMARY OF THE INVENTION

An object of the present invention is to provide a process for operating a workpiece transport system for a press arrangement, in which it is ensured in any condition during the operation of the workpiece transport system that the braking device can apply the required torque.

According to the invention, this object has been achieved by providing that the functioning of the braking device is checked by the application of a predefined torque by the driving device.

According to the invention, the checking determines whether the braking device is still operating so that it is possible to not start the process for operating the workpiece transport system for the press arrangement if the torque applied by the driving device exceeds the maximal holding moment of the braking device. As a result, a secure functioning of the braking device is ensured in every situation, and potential accidents as a result of movements of the workpiece transport system or its parts can be prevented. An enormous increase of safety in the operation of press arrangements is thereby achieved and human lives can be saved.

The predefined torque applied by the driving device is in a range which is slightly lower than the torque to be applied by the braking device. Naturally, the torque applied by the mass of the workpiece and the workpiece transport system have to be taken into account.

Another advantage of the process according to the invention resides in the fact that no additional hardware expenditures are required because standard parts can be used. As a result, the moment of inertia is advantageously also not increased.

One possibility of implementing the checking procedure of the braking device, which can be used in a particularly meaningful manner in practice, will be achieve if the predefined torque is applied by the driving device when the press arrangement is switched off. This represents no loss of time during the operation of the press arrangement and ensures a reliable operation of the braking device each time the press arrangement is switched on again.

Of course, the predefined torque by the driving device can, as an alternative, also be applied when the press arrangement is switched on or at arbitrary points in time during the stoppage of the press arrangement manually by an operator.

When the torque of the braking device is too low, corresponding measures can be taken for the purpose of personal safety. That is, the workpiece transport system and/or the press arrangement can then be switched off.

Other objects, advantages and novel features of the present invention will become apparent from the following detailed description of the invention when considered in conjunction with the accompanying drawings.

BRIEF DESCRIPTION OF THE DRAWINGS

The sole FIGURE is a schematic representation of a workpiece transport system for a press arrangement for carrying out the process according to the present invention.

DETAILED DESCRIPTION OF THE DRAWINGS

A system designated generally by numeral 1 for the transport of workpieces within a conventional press arrangement (not shown) has a belt drive 3 which is driven by way of a transmission 4 by via driving device, e.g., an electric motor 5. Instead of the belt drive 3, the transmission 4 and the electric motor 5, other devices are also contemplated which are used in the known workpiece transport systems 1 for press arrangements.

In order to relieve the belt drive 3, the transmission 4 and the electric motor 5, or to avoid an unintentional movement of the workpiece 2 in the downward direction because of the force of gravity acting upon the latter, a counterweight device 6, which in the present embodiment is pneumatically operated and is known per se, is applied to the belt drive 3. Because the counterweight device 6 cannot securely hold the mass of the workpiece at every point in time securely in any position, a braking device 8 is additionally applied to an output shaft 7 of the electric motor 5. It is, of course, also possible to cause the braking device 8 to be applied to any other point within the workpiece transport system 1, at which the braking device 8 is capable of preventing an unintentional movement of the workpiece 2.

The braking device 8 has at least one but, in the present embodiment, two friction linings 9 constructed as a pure holding brake or static brake. That is, the friction linings 9 are constructed such that they can be used only in an emergency for an operational braking of the workpiece 2. In other words, the linings 9 are used for braking when the workpiece 2 is in motion and, during such operational brakings, are subjected to relatively high wear. In the braking device 8, the holding moment is applied by spring force, and the braking device 8 can be ventilated electrically or hydraulically. The use of a service brake as the braking device 8 is also conceivable.

An encoder or motion pickup device 10 is connected to the output shaft 7 of the electric motor 5 and transmits the respective position of the output shaft 7 and thus of the workpiece 2 as an electrical pulse to a control unit 11. The control unit 11, in turn, is connected with a current transmitter or converter 12 which supplies the electric motor 5 with a defined current intensity and thus controls its driving power and therefore the path covered by the workpiece 2 as well as its speed. The motion pickup 10, the control device 11 and the current transmitter 12 are of a generally known construction and method of operation not be explained in detail.

To avoid an unintentional movement of the workpiece 2 in the downward or upward direction, the braking device 8 will engage every time the workpiece transport system 1 stops. That is, the friction linings 9 are applied to the output shaft 7 and prevent its movement and thus a movement of the workpiece 2. Since, in the event of a possible wear of the friction linings 9, the necessary holding moment can, under certain circumstances, no longer be applied by the braking device 8, the functioning of the braking device 8 is checked by using the electric motor 5 to apply a predefined torque. This can take place cyclically, for example, at each switching-off or switching-on of the workpiece transport system 1 or of the press arrangement, or manually by an operator at any other points in time during a stoppage, for example, within the scope of a service interval.

Thus, while the braking device 8 is closed, the electric motor 5 is acted upon by the current transmitter 12 by way of a defined current I which corresponds, for example, to a torque of 80% of the holding moment of the braking device 8. Subsequently, a summation of the occurring moments takes place, in which case the force applied by the counterweight device 6 and the moment of the braking device 8 act into a positive direction, and the force of the weight of the parts of the workpiece transport system acts into a negative direction. If the holding force of the braking device 8 is higher than the force of the weight, no movement of the system takes place. If the friction linings 9 are worn and the required holding moment therefore does not exist, the torque of the electric motor 5 will predominate and a slipping of the braking device 8 takes place. This movement can be detected by the motion pickup and, when a defined angle of rotation is exceeded, the entire press arrangement can be switched off. Furthermore, it will then be possible to initiate suitable measures relative to personal safety.

The torque applied by the electric motor 5 therefore counteracts the force of the weight of the workpiece transport system 1 or of the workpiece 2 and is in a range which is slightly lower than the holding moment which can be applied by the braking device 8. As a result of this checking procedure, the braking device 8 is ensured to apply the required holding moment at any point in time of the operation of the workpiece transport system 1. In a case in which the torque applied by the driving device 5 exceeds the possible holding moment of the braking device 8, as described above, the workpiece transport system 1 or the press arrangement is immediately switched off, and potential accidents can be avoided by repairing the braking device 8.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Process for operating a workpiece transport system for a press arrangement, comprising driving the workpiece transport system by at least one driving device, holding the at least one driving device in a stoppage position with a braking device when the workpiece transport system stops, and checking functioning of the braking device by application of a predefined torque by the at least one driving device.

2. Process according to claim 1, wherein the predefined torque is applied by the driving device when one of the workpiece transport system and the press arrangement is switched off.

3. Process according to claim 1, wherein the predefined torque is applied by the driving device when one of the workpiece transport system and the press arrangement is switched on.

4. Process according to claim 1, wherein the predefined torque is applied by the driving device at arbitrary points in time during manual stoppage of the press arrangement.

5. Process according to claim 1, further comprising, when the driving device is moved during the checking operation, switching off at least one of the workpiece transport system and the press arrangement.

6. Process according to one of claim 1, further comprising causing the torque applied by the driving device to act against a force of the weight of the workpiece transport system.

7. Process according to claim 1, further comprising causing the torque applied by the driving device to act in a force direction of a weight of the workpiece transport system.

8. Process according to claim 1, further comprising braking an output shaft of the driving device by way of the braking device.

9. System for implementing a process according to claim 1, comprising a workpiece transport system, a driving device operatively connected with the workpiece transport system to drive the workpiece transport system, and a braking device operatively associated with the driving device to hold the driving device in a stoppage position upon stoppage of the workpiece transport system.

10. System according to claim 9, wherein a motion pickup, a control device and a current transmitter are operatively connected with the driving device to control movement of the driving device.

11. System according to claim 9, wherein the driving device is an electric motor.

* * * * *